US005253227A

United States Patent [19]

Wong

[11] Patent Number: 5,253,227

[45] Date of Patent: Oct. 12, 1993

[54] TIME-PIECE

[76] Inventor: Tak-Hoi Wong, Room 6, 2nd Floor, Kai Fuk Industrial Centre, 1 Wang Tung Street, Kowloon Bay, Kowloon, Hong Kong

[21] Appl. No.: 848,912

[22] Filed: Mar. 10, 1992

[30] Foreign Application Priority Data

Mar. 11, 1991 [GB] United Kingdom ..... 9105097

[51] Int. Cl.[5] ..... G04C 17/00

[52] U.S. Cl. ..... 368/69; 368/185; 368/319

[58] Field of Search ..... 368/69, 70, 76, 80, 368/223, 228, 185-187, 319-321

[56] References Cited

U.S. PATENT DOCUMENTS

| | | | |
|---|---|---|---|
| 4,038,814 | 8/1977 | Niida | 368/69 |
| 4,451,159 | 5/1984 | Tanaka | 368/69 |
| 4,905,213 | 2/1990 | Masse et al. | 368/10 |

FOREIGN PATENT DOCUMENTS 1455631 4/1973 United Kingdom .

*Primary Examiner*—Vit W. Miska

*Attorney, Agent, or Firm*—Leydig, Voit & Mayer

[57] ABSTRACT

A time-piece in the form of a wrist-watch which comprises a casing including a dial and a side wall in which a slot is formed, hour and minute hands, drive means located within the casing and supporting the hands on the dial for rotating the hands relative to the dial to indicate time, and a manual operating member located substantially within the casing for rotating the hands relative to the dial by rotation with the hands about corresponding substantially parallel axes. The operating member has a peripheral edge portion of which only a limited region is exposed through the slot in the side wall of the casing, and is movable between an operative position for rotating the hands and an inoperative position not acting upon the hands. A spring is located within the casing and resiliently biasses the operating member towards the inoperative position.

15 Claims, 3 Drawing Sheets

TIME-PIECE

The present invention relates to a time-piece.

BRIEF DESCRIPTION OF THE INVENTION

According to a first aspect of the invention, there is provided a time-piece in the form of a wrist-watch which comprises a casing including a dial and a side wall in which a slot is formed, hour and minute hands, drive means located within the casing and supporting the hands on the dial for rotating the hands relative to the dial to indicate time, and a manual operating member located substantially within the casing for rotating the hands relative to the dial by rotation with the hands about corresponding substantially parallel axes, said operating member having a peripheral edge portion of which only a limited region is exposed through the slot in the side wall of the casing.

According to a second aspect of the invention, there is provided a time-piece which comprises a casing including a dial and a side wall in which a slot is formed, hour and minute hands, drive means located within the casing and supporting the hands on the dial for rotating the hands relative to the dial to indicate time, a manual operating member located substantially within the casing for rotating the hands relative to the dial by rotation with the hands about corresponding substantially parallel axes, said operating member having a peripheral edge portion of which only a limited region is exposed through the slot in the side wall of the casing and being movable between an operative position for rotating the hands and an inoperative position not acting upon the hands, and a spring located within the casing and resiliently biassing the operating member towards the inoperative position.

Preferably, the time-piece further comprises a shaft, wherein the operating member is rotatable on or about the shaft against which the spring engages to bias the operating member towards the inoperative position.

The time-piece may be in the form of a wrist-watch or a clock.

It is advantageous for the time-piece of either aspect of the invention to have the same direction of rotation for the operating member and the hands.

Preferably, the hands of the time-piece of either aspect of the invention are rotatable by the operating member through gear engagement.

It is preferred that a gear wheel is provided in the gear engagement between the hands and the operating member.

The operating member of the time-piece of either aspect of the invention is preferably in the form of a disc.

The operating member of the time-piece of either aspect of the invention may further comprise a cover to cover at least the slot, and preferably the cover covers the entire casing except the dial.

BRIEF DESCRIPTION OF DRAWINGS

The invention will now be more particularly described, by way of example only, with reference to the accompanying drawings, in which.

DETAILED DESCRIPTION OF PREFERRED EMBODIMENTS

Figure 1:
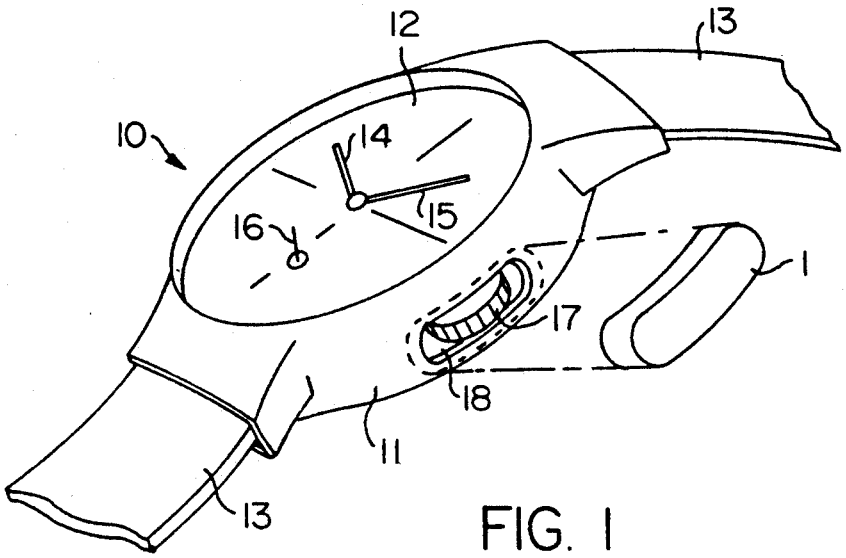
FIG. 1 is a perspective view of a first embodiment of a time-piece in accordance with the invention.

Referring firstly to FIG. 1 of the drawings, there is shown a first embodiment of a time-piece, according to the invention, in the form of a wrist-watch 10 which comprises a casing 11 including a dial 12, and two straps 13 connected to the casing 11. Three hands, namely an hour hand 14, a minute hand 15 and a second hand 16, are provided on the dial 12, as shown. The hands 14 and 15 are rotatable for adjustment to the correct time by means of a manual operating member or wheel 17 which is supported for rotation about an axis parallel to that of the hands 14 and 15. The operating wheel 17 has a limited part of its peripheral edge portion exposed through a slot 18 in the casing side wall so that a user may rotate the wheel 17 by, say, a finger or thumb. A cover 19 is provided for closing the slot 18, thereby covering the operating wheel 17 against operation not intended, by snap-fitting with the casing side wall.

Figure 2:
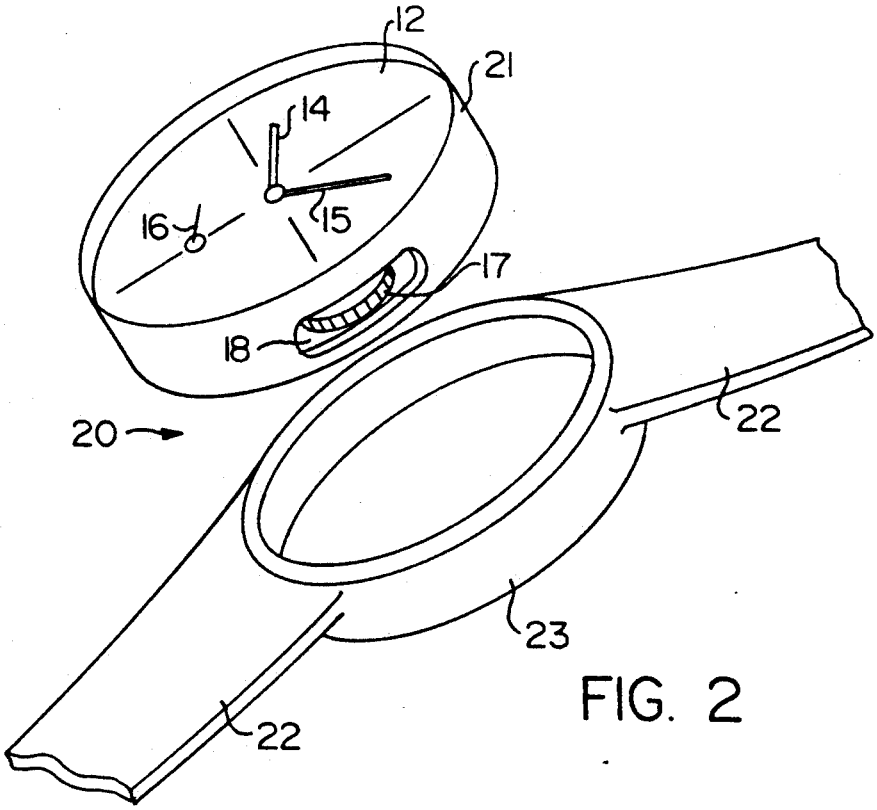
FIG. 2 is a perspective view of a second embodiment of a time-piece in accordance with the invention.

FIG. 2 shows a second embodiment of a time-piece, according to the invention, in the form of a wrist-watch 20 which comprises a casing 21 having internal parts and construction similar to that of the casing 11 of the wrist-watch 10, except that the casing 21 is not directly connected with corresponding straps 22. So far as the casings 11 and 21 are concerned, like parts are designated by like numerals. The straps 22 are integrally moulded with a base cover 23 from rubber or plastics material. The casing 21 is in use carried within the cover 23 which covers the entire casing 21 except the dial 12. The fitting between the casing 21 and the base cover 23 is sufficiently tight to render the wrist-watch 20 waterproof.

Figure 3:
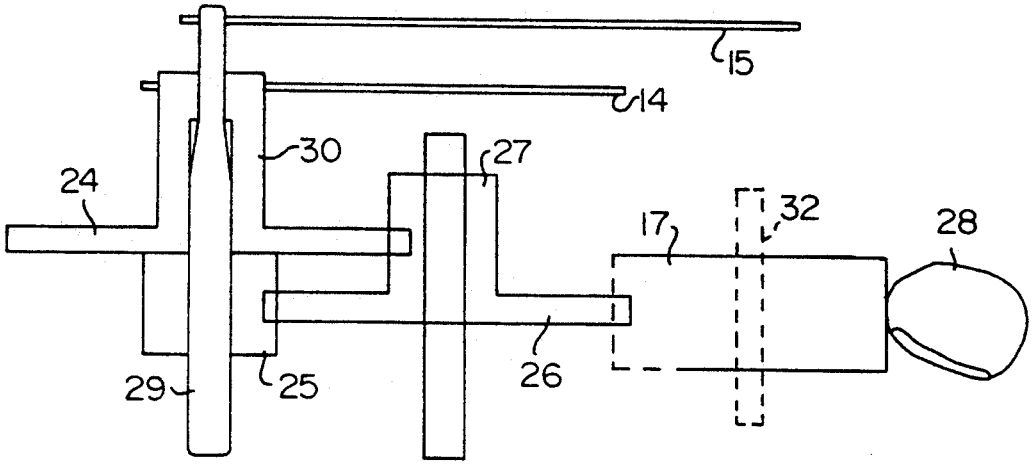
FIGS. 3 and 4 show a first construction of relevant internal parts of the time-piece of FIG. 1 or 2.
Figure 4:
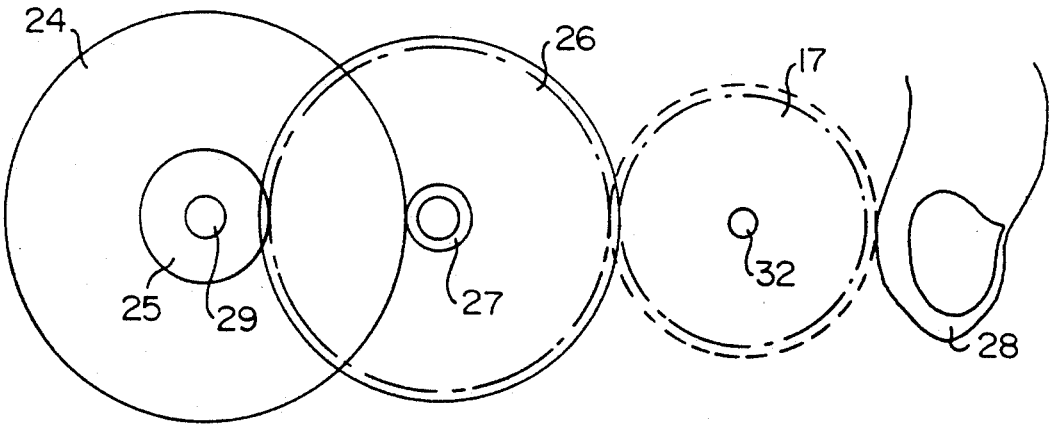

Relevant internal parts of either wrist-watch 10 or 20 in a first internal construction are shown in FIGS. 3 and 4, which include the operating wheel 17, a gear wheel 24 for the hour hand 14, a pinion 25 located co-axially with the gear wheel 24 for the minute hand 15, and an integral gear wheel 26 and pinion 27 provided between the operating wheel 17 and assembly of the gear wheel 24 and pinion 25. The operating wheel 17, which in itself is a gear wheel, is in mesh with the intermediate gear wheel 26, whereas the gear wheel 24 and the pinion 25 are in mesh with the intermediate pinion 27 and gear wheel 26, respectively.

The pinion 25 has a fixed shaft 29 about which it is rotatable. The shaft 29 passes freely through the gear wheel 24 and an integral sleeve 30 upstanding therefrom so that the gear wheel 24 and the sleeve 30 are supported on and rotatable relative to the pinion 25. The arrangement is such that when the operating wheel 17 is rotated by, say, a thumb 28 of a user, the gear wheel 24 and the pinion 25 will be simultaneously rotated at a speed ratio of 1 to 12 by the integral pinion 27 and gear wheel 26. The hour and minute hands 14 and 15 are supported as press-fit on the upper ends of the sleeve 30 and the shaft 29, respectively.

Figure 5:
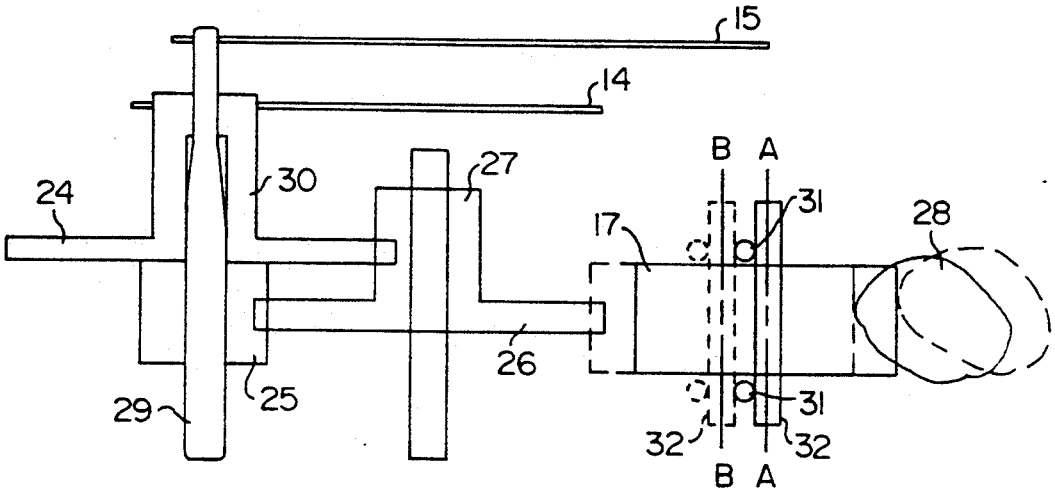
FIGS. 5 and 6 show a second construction of relevant internal parts of the time-piece of FIG. 1 or 2.
Figure 6:
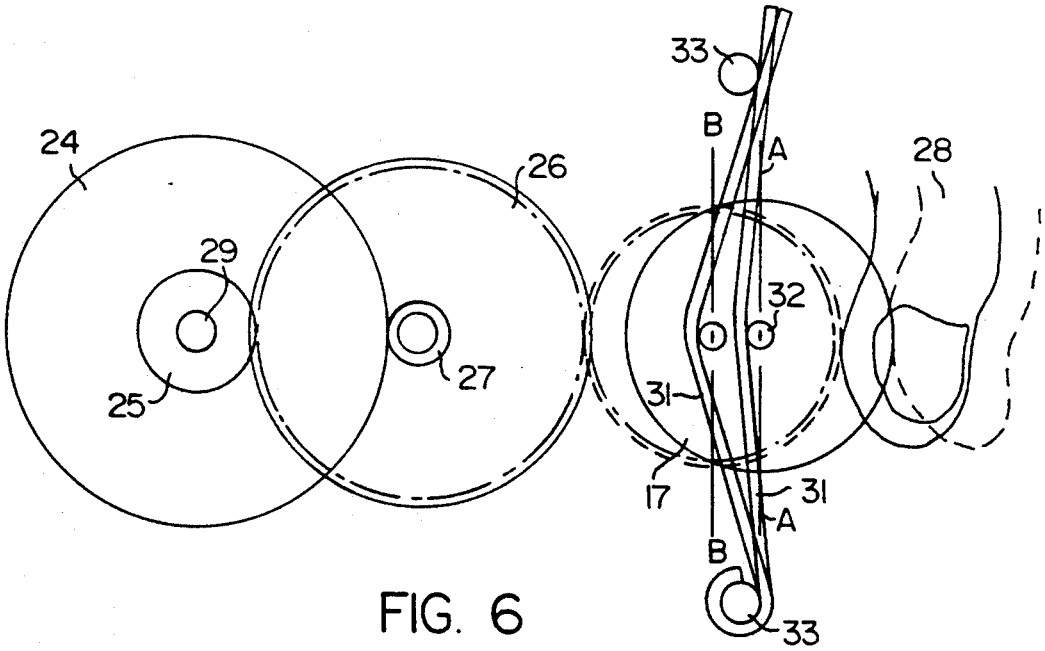

FIGS. 5 and 6 show a second internal construction of either wrist-watch 10 or 20, in which the same parts are designated by the same numerals. The second construction is very similar to the first construction, except that the operating wheel 17 is movable radially relative to the casing 11 between a non-engaging position A—A and an engaging position B—B with the intermediate gear wheel 26. The operating wheel 17 is resiliently biassed towards the non-engaging position A—A by two wire springs 31, each being supported in position by two posts 33 at corresponding ends, in that the upper and lower ends of a shaft 32 of the operating wheel 17 engage the middle portions of the corresponding springs 31.

It will be appreciated that the second construction prevents accidental adjustment of the hands 14 and 15 unless adjustment is intentional by pressing in the operating member 17 to engage with the intermediate gear wheel 26.

The use of the intermediate gear wheel 26 and pinion 27 enables the hands 14 and 15 to be rotated by the operating member 17 in the same angular direction, thereby giving a user a natural feeling.

Although this is not shown in the drawings, each wrist-watch 10 or 20 includes a quartz drive mechanism for driving the hands 14 to 16 to indicate time. The driving action is applied to the pinion 25 for the minute hand 15, and is transmitted by means of the intermediate gear wheel 26 and pinion 27 to the gear wheel 24 for the hour hand 14. Concerning the second hand 16, the drive transmission path is omitted from the description, for simplicity, as it does not form part of the invention and will be apparent to persons skilled in the art of watch (clock) making.

It is to be appreciated that the invention can equally be applied to a clock.

The invention has been described by way of example only, and various modifications of and/or alterations to the described embodiments may be made by a person skilled in the art without departing from the scope of the invention as specified in the appended claims.

What is claimed is:

1. A time-piece in the form of a wrist-watch comprising a casing including a dial and a side wall having a slot, hour and minute hands, mechanical drive means located within the casing and supporting the hands on the dial for mechanically rotating the hands relative to the dial to indicate time, and a manual operating member located substantially within the casing for gearingly engaging said drive means for rotating the hands relative to the dial in response to rotation of said operating member, the hands and said operating member rotating about corresponding substantially parallel axes, said operating member having a peripheral edge portion, only a part of the peripheral edge portion being exposed through the slot in the side wall of the casing.

2. A time-piece as claimed in claim 1, wherein the direction of rotation of the operating member and of the hands is the same.

3. A time-piece as claimed in claim 1, wherein a gear wheel is provided in the gear engagement between the hands and the operating member.

4. A time-piece as claimed in claim 1, wherein the operating member is in the form of a disc.

5. A time-piece as claimed in claim 1, further comprising a cover to cover at least the slot.

6. A time-piece as claimed in claim 5, wherein the cover covers the entire casing except the dial.

7. A time-piece comprising a casing including a dial and a side wall having a slot, hour and minute hands, mechanical drive means located within the casing and supporting the hands on the dial for mechanically rotating the hands relative to the dial to indicate time, and a manual operating member located substantially within the casing for gearingly engaging said drive means for rotating the hands relative to the dial in response to rotation of said operating member, the hands and said operating member rotating about corresponding substantially parallel axes, said operating member having a peripheral edge portion, only a part of the peripheral edge portion being exposed through the slot in the side wall of the casing, said operating member being movable between an operative position for gearing engagement of and rotating the hands and an inoperative position disengaged from the hands, and a spring located within the casing and resiliently biasing the operating member toward the inoperative position.

8. A time-piece as claimed in claim 7, further comprising a shaft, wherein the operating member is rotatable on or about the shaft against which the spring engages to bias the operating member towards the inoperative position.

9. A time-piece as claimed in claim 7, being in the form of a wrist-watch.

10. A time-piece as claimed in claim 7, being in the form of a clock.

11. A time-piece as claimed in claim 7, wherein the direction of rotation of the operating member and of the hands is the same.

12. A time-piece as claimed in claim 7, wherein the operating member is in the form of a disc.

13. A time-piece as claimed in claim 7, further comprising a cover to cover at least the slot.

14. A time-piece as claimed in claim 13 wherein the cover covers the entire casing except the dial.

15. A time-piece as claimed in claim 7 wherein a gear wheel is provided in the gear engagement between the hands and the operating member.

* * * * *